US009548591B2

(12) United States Patent
Zheng et al.

(10) Patent No.: US 9,548,591 B2
(45) Date of Patent: Jan. 17, 2017

(54) SPARK PLUG INSULATOR HAVING AN ANTI-FOULING COATING AND METHODS FOR MINIMIZING FOULING

(71) Applicant: Fram Group IP, LLC, Lake Forest, IL (US)

(72) Inventors: Jing Zheng, Findlay, OH (US); Jeffrey T. Boehler, Holland, OH (US); Prabhu Megharaj, Findlay, OH (US); Philip Treier, Perrysburg, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 15/008,867

(22) Filed: Jan. 28, 2016

(65) Prior Publication Data

US 2016/0226224 A1 Aug. 4, 2016

Related U.S. Application Data

(60) Provisional application No. 62/109,133, filed on Jan. 29, 2015.

(51) Int. Cl.

| | |
|---|---|
| ***H01T 13/20*** | (2006.01) |
| ***H01T 13/06*** | (2006.01) |
| *H01T 13/14* | (2006.01) |
| *H01T 13/38* | (2006.01) |

(52) U.S. Cl.

CPC ..... *H01T 13/06* (2013.01); *H01T 13/20* (2013.01); *H01T 13/14* (2013.01); *H01T 13/38* (2013.01)

(58) Field of Classification Search

CPC ..... H01T 31/06; H01T 13/20

USPC ..... 313/141

See application file for complete search history.

(56) References Cited

U.S. PATENT DOCUMENTS

| | | | | |
|---|---|---|---|---|
| 3,278,785 | A * | 10/1966 | Hauth, Jr. | H01T 13/38 219/76.16 |
| 4,914,344 | A | 4/1990 | Watanabe et al. | |
| 5,187,404 | A | 2/1993 | Straub | |
| 5,859,491 | A | 1/1999 | Nishikawa et al. | |
| 6,060,821 | A | 5/2000 | Suzuki et al. | |
| 6,274,971 | B1 | 8/2001 | Sugimoto et al. | |
| 8,981,632 | B2 * | 3/2015 | Unger | H01T 13/14 313/118 |
| 2003/0051341 | A1 | 3/2003 | Nishikawa et al. | |
| 2007/0188063 | A1 * | 8/2007 | Lykowski | H01T 13/38 313/137 |
| 2012/0139405 | A1 | 6/2012 | Unger et al. | |
| 2013/0300278 | A1 * | 11/2013 | Rohrbach | H01T 13/38 313/141 |
| 2014/0131927 | A1 | 5/2014 | Unger et al. | |

OTHER PUBLICATIONS

International Search Report and Written Opinion of PCT/US2016/015317 dated Apr. 11, 2016.

* cited by examiner

*Primary Examiner* — Vip Patel
(74) *Attorney, Agent, or Firm* — Elizabeth A. Peters; Barnes & Thornburg LLP

(57) ABSTRACT

An insulator for a spark plug comprises a first segment surrounding the terminal, a second segment extending from the first segment, and a third segment extending from the second segment. A gap is disposed between the third segment of the insulator and the outer shell. At least one coating having a least one layer is disposed on a surface of the third segment.

32 Claims, 11 Drawing Sheets

(a) (b) (c)

(a) (b) (c)

(a)

(b)

(a)

(b)

(a)

(b)

SPARK PLUG INSULATOR HAVING AN ANTI-FOULING COATING AND METHODS FOR MINIMIZING FOULING

CROSS-REFERENCE

This application claims the benefit of priority under 35 U.S.C. §119(e) to U.S. Provisional Patent Application No. 62/109,133, filed on Jan. 29, 2015, the entire disclosure of which is incorporated herein.

BACKGROUND

1. Field of the Disclosure

The present disclosure relates generally to spark plugs and, more particularly, to methods for applying coatings to insulators of spark plugs to minimize fouling.

2. Description of the Background

Spark plugs used as igniters in internal combustion engines are subjected to a condition known as "fouling." Over time, carbon and other products of combustion can accumulate on the spark plug, including the surface of an insulator tip of the spark plug, which is typically positioned at or near a boundary of unmixed fuel, or at or near the center electrode tip. The products of combustion of a gasoline engine include particles of fuel additives such as Methylcyclopentadienyl Manganese Tricarbonyl (MMT) and Ferrocene, which are often added to gasoline as an octane enhancement. Normally, accumulated soot that is located near the spark point of the spark plug would be burned off from the heat of the combustion process. However, because the exposed surface of the insulator tip may not be located in or about a spark gap between the center electrode tip and ground electrode, accumulated combustion soot along the insulator tip may not be burned off. If significant amounts of these combustion products accumulate, the spark may not properly form between the center and ground electrodes. More particularly, the accumulated combustion soot creates an electrical short circuit such that the electrical charge from the center electrode travels across the surface of the insulator and back to the outer metal shell instead of across the spark gap to the ground electrode. This process is called "fouling."

As noted above, MMT and/or other additives have been added to gasoline or fuel to increase the octane numbers instead of using a more expensive refining process. MMT added to the fuel generates conductive combustion residual that deposit on the internal surfaces of the combustion engine, including the insulator of a spark plug that extends into the engine combustion chamber. It has been found that MMT deposits on a surface of the spark plug insulator significantly reduce the resistivity of the spark plug insulator and may cause instances of side-firing or misfiring during ignition events. In turn, the MMT deposits have dramatically reduced the useful life of spark plugs, leading to high costs due to frequent replacement of spark plugs. MMT deposits may also reduce fuel mileage and/or increase hydrocarbon emissions. While some methods have been developed to reduce or minimize MMT deposits, the current methods have their challenges.

SUMMARY

In illustrative embodiments, a spark plug for an internal combustion engine comprises an elongated center electrode having a center electrode tip at a first end and a terminal proximate a second end opposite the first end, an insulator surrounding at least a portion of the center electrode, and an outer shell surrounding at least a portion of the insulator. The insulator comprises a first segment surrounding at least a portion of the terminal, a second segment extending from the first segment, and a third segment extending from the second segment, wherein a gap is disposed between the third segment of the insulator and the outer shell such that at least a portion of the third segment of the insulator is exposed to a combustion chamber when the spark plug is disposed within an internal combustion engine. A coating is applied to at least a portion of the third segment, wherein the coating is formed of a first layer disposed on at least a portion of a surface of the third segment and a second layer disposed on at least a portion of the first layer.

In other illustrative embodiments, an insulator for a spark plug comprises a first segment surrounding at least a portion of the terminal, a second segment extending from the first segment, and a third segment extending from the second segment. A coating is applied to at least a portion of the third segment, wherein the coating is formed of a first layer disposed on at least a portion of a surface of the third segment and a second layer disposed on at least a portion of the first layer.

In any of the embodiments herein, each of the first and second layers may be formed of a glaze material, wherein the glaze material may be the same for both the first and second layers.

In any of the embodiments herein, the first layer may be formed of a first glaze material having a first softening point and the second layer may be formed of a second glaze material having a second softening point that is less than the first softening point.

In any of the embodiments herein, the first glaze material and the second glaze material may be different materials.

In any of the embodiments herein, a first thickness of the first layer and a second thickness of the second layer may be different.

In any of the embodiments herein, the coating may extend between an end of the insulator disposed adjacent the center electrode and a point where the outer shell retains the insulator in position.

In any of the embodiments herein, the coating may extend along a surface of the insulator and ends at a point that is spaced from the center electrode or a point where the outer shell retains the insulator in position.

In any of the embodiments herein, a third layer may be disposed on at least a portion of the second layer.

In any of the embodiments herein, the first layer may be formed of a first glaze material and the second layer may be formed of a second glaze material, wherein at least one of the first and second glaze materials includes a refractory powder.

In any of the embodiments herein, the refractory powder may be selected from the group consisting of a high temperature ceramic powder, alumina, zirconium oxide ($ZrO_2$), mullite, yittrium oxide ($Y_2O_3$), magnesium oxide (MgO), lanthium oxide ($La_2O_3$), boron nitride (BN), aluminum nitride (AlN), and combinations thereof.

In any of the embodiments herein, a gap may be formed between the insulator and the center electrode.

In any of the embodiments herein, the third segment of the insulator may be tapered from a first end adjacent the second segment toward a second end opposite the second segment such that a thickness of the insulator at the second end is less than a thickness of the insulator at the first end.

In further illustrative embodiments, a spark plug for an internal combustion engine comprises an elongated center electrode having a center electrode tip at a first end and a terminal proximate a second end opposite the first end, an insulator surrounding at least a portion of the center electrode, and an outer shell surrounding at least a portion of the insulator. The insulator comprises a first segment surrounding the terminal, a second segment extending from the first segment, and a third segment extending from the second segment, wherein a gap is disposed between the third segment of the insulator and the outer shell such that at least a portion of the third segment of the insulator is exposed to a combustion chamber when the spark plug is disposed within an internal combustion engine. A first coating is applied to a first portion of the third segment and a second coating is applied to a second portion of the third segment, wherein at least a portion of the second coating is disposed between the first coating and the second segment.

In illustrative embodiments, an insulator for a spark plug comprises a first segment surrounding the terminal, a second segment extending from the first segment, and a third segment extending from the second segment. A first coating is applied to a first portion of the third segment and a second coating is applied to a second portion of the third segment, wherein at least a portion of the second coating is disposed between the first coating and the second segment.

In any of the embodiments herein, the first and second coatings may abut one another.

In any of the embodiments herein, the first and second coatings may not overlap.

In any of the embodiments herein, the first coating may be comprised of a first glaze material having a first softening point and the second coating may be comprised of a second glaze material having a second softening point that is lower than the first softening point.

In any of the embodiments herein, the first and second glaze materials may be different materials.

In any of the embodiments herein, a third coating may be applied to a third portion of the third segment between the second coating and the second segment.

In any of the embodiments herein, the first coating may be formed of a first glaze material and the second coating may be formed of a second glaze material, wherein at least one of the first and second glaze materials includes a refractory powder.

In any of the embodiments herein, the refractory powder may be selected from the group consisting of a high temperature ceramic powder, alumina, zirconium oxide ($ZrO_2$), mullite, yittrium oxide ($Y_2O_3$), magnesium oxide (MgO), lanthium oxide ($La_2O_3$), boron nitride (BN), aluminum nitride (AlN), and combinations thereof.

In any of the embodiments, an insulator for a spark plug comprises a first segment surrounding at least a portion of a terminal, a second segment extending from the first segment, a third segment extending from the second segment, and a coating applied to at least a portion of the third segment, wherein the coating is formed of a first layer disposed on at least a portion of a surface of the third segment and a second layer disposed on at least a portion of the first layer.

In any of the embodiments, each of the first and second layers may be formed of a glaze material, and the glaze material may be the same for both the first and second layers.

In any of the embodiments, the first layer may be formed of a first glaze material having a first softening point and the second layer may be formed of a second glaze material having a second softening point, and the second softening point may be less than the first softening point.

In any of the embodiments, the first glaze material and the second glaze material may be of different materials.

In any of the embodiments, a first thickness of the first layer and a second thickness of the second layer may be different.

In any of the embodiments, a third layer may be disposed on at least a portion of the second layer.

In any of the embodiments, the first layer may be formed of a first glaze material and the second layer may be formed of a second glaze material, wherein at least one of the first and second glaze materials includes a refractory powder.

In any of the embodiments, the refractory powder may be selected from the group consisting of a high temperature ceramic powder, alumina, zirconium oxide ($ZrO_2$), mullite, yittrium oxide ($Y_2O_3$), magnesium oxide (MgO), lanthium oxide ($La_2O_3$), boron nitride (BN), aluminum nitride (AlN), and combinations thereof In any of the embodiments, a gap may be formed between the insulator and the center electrode.

In any of the embodiments, the third segment of the insulator may be tapered from a first end adjacent the second segment toward a second end opposite the second segment such that a thickness of the insulator at the second end is less than a thickness of the insulator at the first end.

In any of the embodiments, an insulator for a spark plug comprises a first segment surrounding the terminal, a second segment extending from the first segment, a third segment extending from the second segment, and a first coating applied to a first portion of the third segment, and a second coating applied to a second portion of the third segment, wherein at least a portion of the second coating is disposed between the first coating and the second segment.

In any of the embodiments, the first and second coatings may abut one another and may not overlap.

In any of the embodiments, the first coating may be comprised of a first glaze material having a first softening point and the second coating may be comprised of a second glaze material having a second softening point that is lower than the first softening point.

In any of the embodiments, the first and second glaze materials may be different materials.

In any of the embodiments, a third coating may be applied to a third portion of the third segment between the second coating and the second segment.

In any of the embodiments, the first coating may be formed of a first glaze material and the second coating may be formed of a second glaze material, wherein at least one of the first and second glaze materials includes a refractory powder.

In any of the embodiments, the refractory powder is selected from the group consisting of a high temperature ceramic powder, alumina, zirconium oxide ($ZrO_2$), mullite, yittrium oxide ($Y_2O_3$), magnesium oxide (MgO), lanthium oxide ($La_2O_3$), boron nitride (BN), aluminum nitride (AlN), and combinations thereof.

BRIEF DESCRIPTION OF THE DRAWINGS

The foregoing and other features, and advantages of the disclosure are apparent from the following detailed description taken in conjunction with the accompanying drawings in which.

Figure 1:
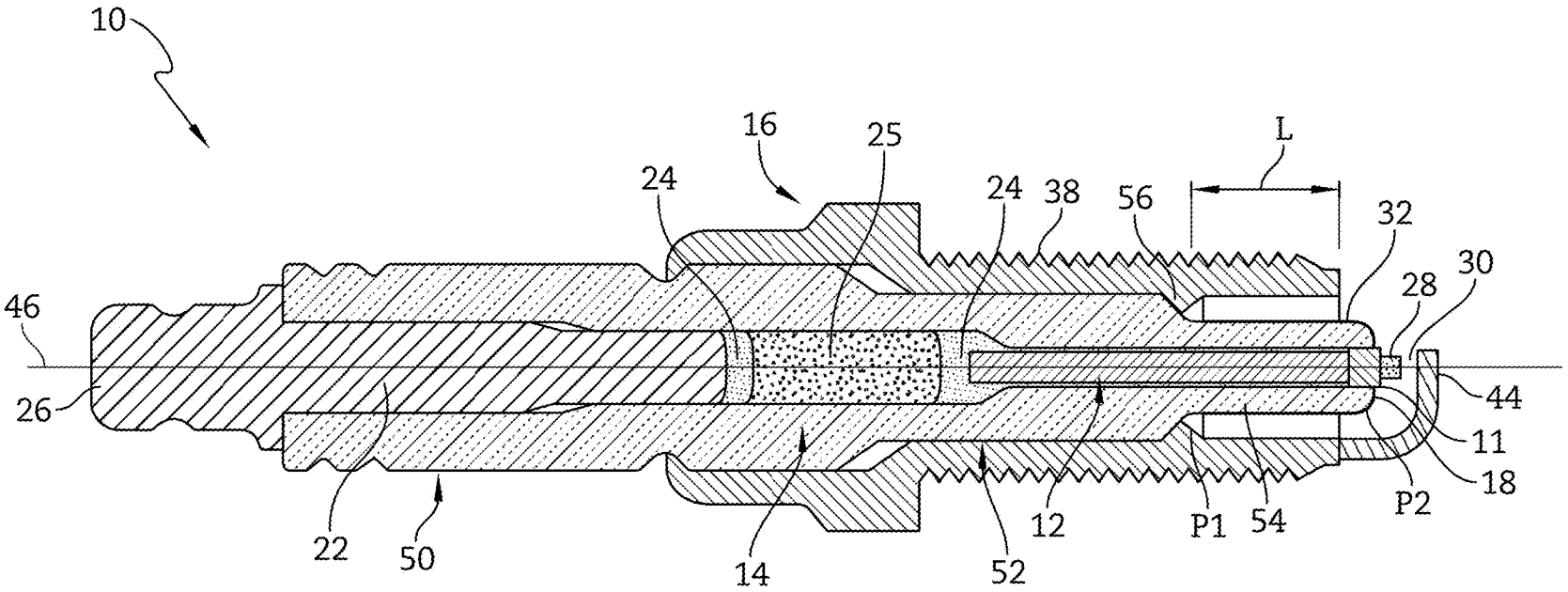
FIG. 1 (PRIOR ART)
FIG. 1 is a cross-sectional view depicting a prior art spark plug including a center electrode, an insulator surrounding the center electrode, a metal shell surrounding the insulator, and a ground electrode extending from the metal shell and spaced from the center electrode to create a spark gap with the center electrode.

The subject matter is particularly pointed out and distinctly claimed in the claims at the conclusion of the specification. Other aspects and advantages of the present disclosure will become apparent upon consideration of the following detailed description, wherein similar structures have like or similar reference numerals.

DETAILED DESCRIPTION

The present application is directed to coatings for application to spark plug insulators, methods for applying such coatings, and methods for minimizing fouling. While the methods of the present application may be embodied in many different forms, several specific embodiments are discussed herein with the understanding that the present application is to be considered only as an exemplification of the principles of the application, and it is not intended to limit the application to the embodiments illustrated.

An exemplary prior art spark plug 10 in which the methods of the present disclosure may be implemented is depicted in FIG. 1. The spark plug 10 is designed for use in an internal combustion engine. The spark plug 10 protrudes into a combustion chamber (not shown) of the engine through a threaded bore provided in an engine head (not shown). The spark plug 10 includes a cylindrical center electrode 12 extending along an axial length of the spark plug 10, a ceramic or similarly comprised insulator 14 that concentrically surrounds the center electrode 12, and an outer shell 16 that concentrically surrounds the insulator 14 and which is generally made of a metallic material.

In the exemplary spark plug 10 of FIG. 1, a tip portion 11 of the center electrode 12 may extend away from the insulator 14 at one end of the spark plug 10. The tip portion 11 of the center electrode 12 may alternatively end in alignment with an outer edge of a tip 18 of the insulator 14. Regardless, a noble metal tip 28 may be attached at an end of the center electrode 12. The center electrode 12 may be made of materials such as nickel, gold, palladium, iridium, platinum, or some alloy thereof in any suitable form for enabling proper spark plug functioning. For example, a noble metal tip 28 consisting of a finewire may be added to the end of the center electrode 12 to improve resistance to wear and maintain a sparking gap between the center electrode 12 and/or a ground electrode 44 coupled to the outer shell 16.

As illustrated in FIG. 1, the insulator 14 may have an elongated, substantially cylindrical body with multiple segments of varying diameters. More particularly, the insulator 14 includes a first segment 50 that surrounds at least a portion of a terminal 26 of the spark plug 10, a second segment 52 that extends from the first segment 50 and which may have a diameter smaller than a diameter of the first segment 50, and a third segment 54 extending from the second segment 52 and opposite the first segment 50, which may have a diameter that is smaller than the diameters of the first and second segments 50, 52. The third segment 54 is formed by a portion of the insulator 14 that is exposed to the combustion chamber. More particularly, the third segment 54 extends between a point P1 where a gasket seat 56 retains the insulator 14 within the outer shell 16 and a point P2 at an outer or top edge of the insulator tip 18. The insulator tip 18 is the portion of the insulator that extends beyond the outer shell 16, and substantially surrounds the center electrode 12 near the noble metal tip 28 (if present).

The outer shell 16 may include an integral external threaded portion 38 for engagement with an engine and/or a hex nut (not shown) for tightening the spark plug 10 with a wrench when it is engaged in an engine. Connected to the outer shell 16 is the ground electrode 44, which extends away from the outer shell 16. The ground electrode 44 and the noble metal tip 28 of center electrode 12 define a spark plug gap 30. The ground electrode 44 is electrically connected with the threaded portion 38 of the outer shell 16 to form an electrical ground when the spark plug 10 is mounted in an engine cylinder.

The spark plug 10 is configured to be utilized in an automobile engine that supplies electrical current to the spark plug 10 to create the spark. Specifically, one end of the center electrode 12 is electrically connected to a terminal stud 22 through an electrically conductive glass seal 24. In alternate embodiments, an additional resistor element 25 may be attached to the glass seal 24. As is known in the related arts, the terminal stud 22 may be made from steel or a steel based alloy material with a nickel plated finish. The terminal stud 22 further connects to a terminal 26 that protrudes from the insulator and attaches to an ignition cable (not shown) that supplies electrical current to the spark plug 10 when connected.

While a particular spark plug 10 is depicted in FIG. 1 for exemplary purposes, one skilled in the art will understand that the principles of the present disclosure generally relate to the insulator 14 and features of the insulator and, thus, can be applied to any spark plug having an insulator.

Figure 2:
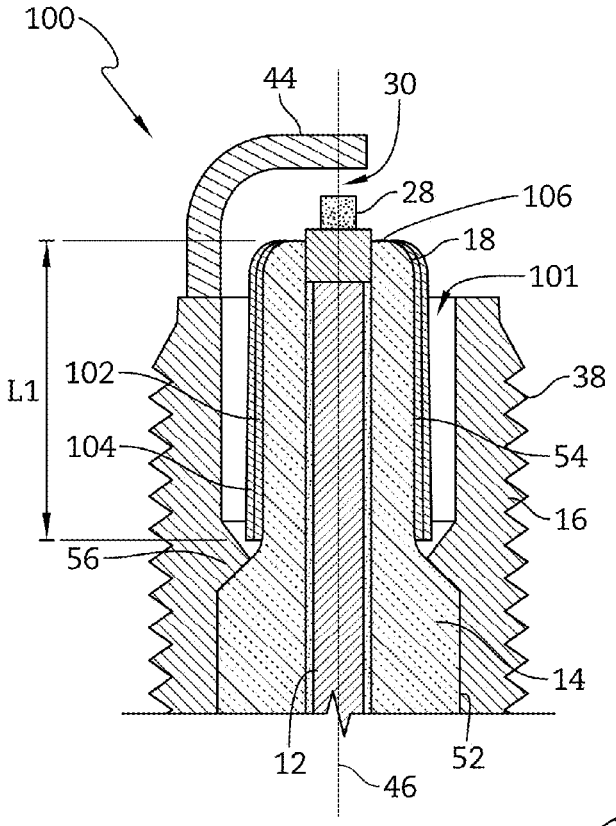
FIG. 2 is a partial cross-sectional view of a first embodiment of a spark plug of the present disclosure, wherein the insulator of the spark plug is depicted as having a coating comprised of multiple layers of a same glaze material or materials.

A first embodiment of a spark plug 100 (similar to the spark plug 10 of FIG. 1) and a method of applying an anti-fouling coating (e.g. an anti-MMT fouling coating) to the spark plug 100 are depicted in FIG. 2. The spark plug 100 includes an insulator 14 having a coating 101 formed of at least two layers 102, 104. Each of the layers 102, 104 is formed of one or more glaze materials. In an exemplary embodiment, the two layers 102, 104 may be formed of the same glaze material or materials to increase a thickness of the overall coating 101 such that, for example, the coating is capable of absorbing more MMT deposits. The spark plug 100 may be manufactured in a typical fashion and, thereafter, the coating 101 may be applied. In an exemplary embodiment, both layers 102, 104 of the coating 101 may be applied and the coating 101 may thereafter be fired. In a further exemplary embodiment, the first layer 102 of the coating 101 may be applied and fired and, thereafter, the second layer 104 of the coating 101 may be applied and fired.

While the coating 101 is shown as having two layers, the coating 101 may have two or more layers. If more than two layers are utilized, the insulator may be fired after each layer is applied, after all of the layers are applied, or at any suitable interval. In one exemplary embodiment having three layers, a first layer may be applied and fired and then second and third layers may be applied and fired.

Any one or more of the layers described with respect to FIG. 2 may have the same or different thicknesses. Further, a length L1 along a longitudinal axis 46 of the individual layers may be the same or an innermost layer adjacent the insulator 14 may have a length that is less than layers disposed over the innermost layer. In an exemplary embodiment, the length of each layer from the innermost layer to an outermost layer may progressively get smaller. While the layers 102, 104 appear in FIG. 1 to begin at a top edge 106 of the insulator 14 and extend along an entirety of the insulator 14 that is exposed to the combustion chamber (to a gasket seat 56 between the outer shell 16 and the insulator 14), one or more of the layers may not extend the entire length of the exposed portion of the insulator 14. In illustrative embodiments, one or more of the layers 102, 104 may extend around the top edge 106 of the insulator tip 18 to a point adjacent or slightly spaced from the center electrode 12. In an exemplary embodiment, each of the layers 102, 104 may not begin at the top edge 106 of the tip portion 18 of the insulator 14 and/or may not extend to the gasket seat 56 of the outer shell 56. In other words, the one or more of the layers 102, 104 may not extend along the entirety of the insulator 14 that is disposed within the combustion chamber.

Figure 3:
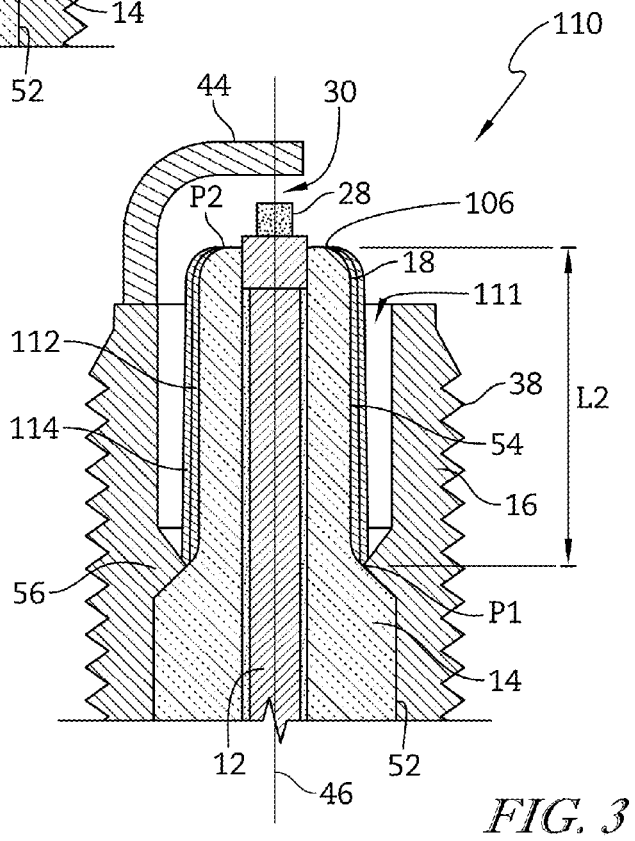
FIG. 3 is a partial cross-sectional view of a second embodiment of a spark plug of the present disclosure, wherein the insulator of the spark plug is depicted as having a coating comprised of multiple layers of a different glaze material or materials.

A second embodiment of a spark plug 110 (similar to the spark plug 10 of FIG. 1) and a method of applying an anti-fouling coating (e.g. an anti-MMT fouling coating) to the spark plug 110 are depicted in FIG. 3. The spark plug 110 includes an insulator 14 having a coating 111 formed of at least two layers 112, 114. Each of the layers 112, 114 is formed of one or more glaze materials. In an exemplary embodiment, the two layers 112, 114 may be formed of a different glaze material or materials. In an exemplary embodiment, an inner layer 112 is a higher softening point glaze material and an outer layer 114 is a lower softening point glaze. The spark plug 110 may be manufactured in a typical fashion and, thereafter, the coating 111 may be applied. In an exemplary embodiment, both layers 112, 114 of the coating 111 may be applied and the coating 111 may thereafter be fired. In a further exemplary embodiment, the first layer 112 of the coating 111 may be applied and fired and, thereafter, the second layer 114 of the coating 111 may be applied and fired.

While the coating 111 is shown as having two layers, the coating 111 may have two or more layers. If more than two layers are utilized, in an illustrative embodiment, each layer from the innermost to the outermost layer may have a progressively lower softening point. Further, if two or more layers are utilized, the insulator 14 may be fired after each layer is applied, after all of the layers are applied, or at any suitable interval. In one exemplary embodiment having three layers, a first layer may be applied and fired and then second and third layers may be applied and fired.

The coating 111 with two or more layers having different glaze materials allows the outermost layer 114 (having a lower softening point) to actively absorb, for example, MMT deposits at a lower temperature. More particularly, as the glaze material of the outer layer 114 begins to soften, the glaze material of the outer layer 114 begins to absorb MMT deposits, which may then flake off with the glaze material of the outer layer 114 due to devitrification. Once the glaze material of the outer layer 114 begins to flake off and the temperature further increases, the glaze material of the inner layer 112 begins to soften and absorb MMT deposits. More than two layers would provide the same effect with more varying softening points and, thus, varying temperatures at which the glaze materials thereof flake off.

Any one or more of the layers described with respect to FIG. 3 may have the same or different thicknesses. Further, a length L2 along the longitudinal axis 46 of the individual layers may be the same or an innermost layer adjacent the insulator 14 may have a length that is less than layers disposed over the innermost layer. In an exemplary embodiment, the length of each layer may from the innermost to an outermost layer progressively get larger. While the layers 112, 114 appear in FIG. 3 to begin at the top edge 106 of the insulator 14 and extend along an entirety of the insulator 14 that is exposed to the combustion chamber (to the gasket seat 56 between the outer shell 16 and the insulator 14), one or more of the layers may not extend the entire length of the exposed portion of the insulator 14. In an exemplary embodiment, each of the layers 112, 114 may not begin at the end 106 of the tip portion 18 of the insulator 14 and/or may not extend to the gasket seat 56 of the outer shell 56. In other words, the one or more of the layers 112, 114 may not extend along the entirety of the insulator 14 that is disposed within the combustion chamber.

Figure 4:
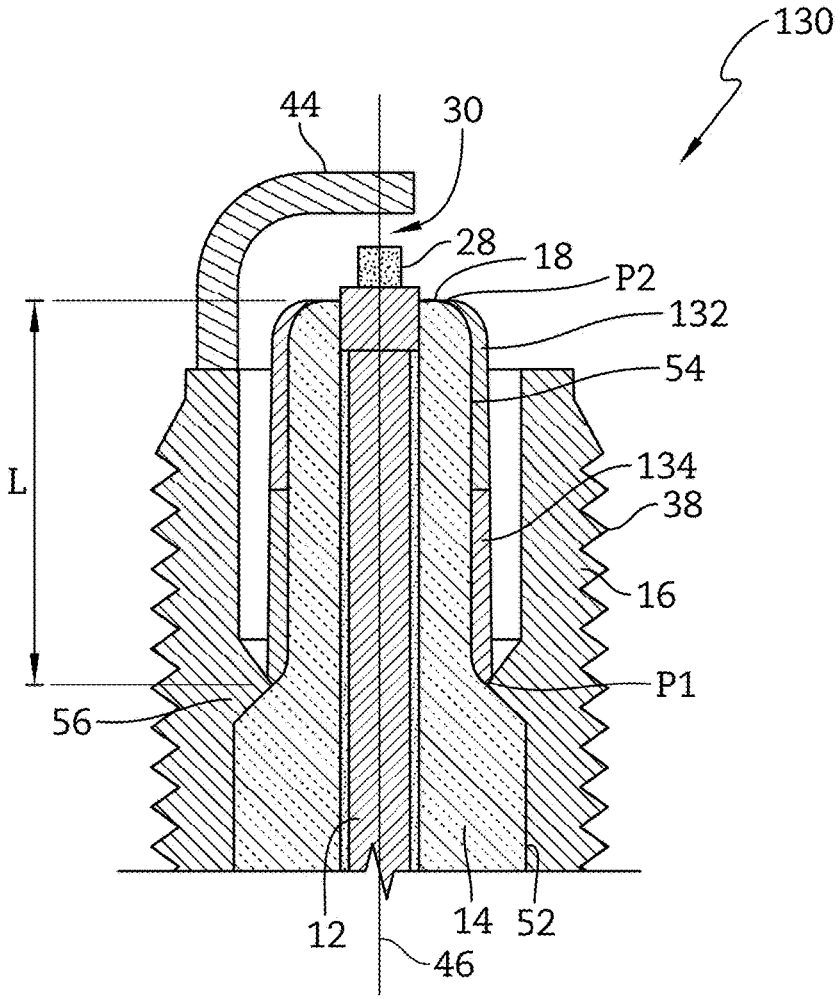
FIG. 4 is a partial cross-sectional view of a third embodiment of a spark plug of the present disclosure, wherein the insulator of the spark plug is depicted as having multiple coatings disposed therein.

A third embodiment of a spark plug 130 (similar to the spark plug 10 of FIG. 1) and a method of applying anti-fouling coatings (e.g. an anti-MMT fouling coatings) to the spark plug 130 are depicted in FIG. 4. The spark plug 130 includes an insulator 14 having first and second coatings 132, 134 formed on a surface of the insulator 14. In illustrative embodiments, the first coating 132 extends from a point on the insulator 14 adjacent the center electrode 12 to a point along a length of the third segment 54 of the insulator 14. Alternatively, the first coating 132 may begin at a point that is spaced from the center electrode 12. In illustrative embodiments, the second coating 134 abuts the first coating 132 and extends to a point adjacent the gasket seat 56. The second coating 134 is disposed between the first coating 132 and the second segment 54 of the insulator 14. Alternatively, the second coating 134 may not extend to the gasket seat 56. In other illustrative embodiments, there may be a gap disposed between the first and second coatings 132, 134 or the first and second coatings 132, 134 may overlap at ends thereof. In an illustrative embodiment, the first layer 132 may extend along the insulator 14 for a distance of between about 1 millimeter (mm) and about 5 millimeters (mm). Any one or more of the coatings described with respect to FIG. 4 may have the same or a different thickness. Still further, any of the coatings 132, 134 (or additional coatings, if used), may include any number of layers, for example, as described above with respect to FIGS. 2 and 3. Regardless, each of the coatings 132, 134 is formed of at least one glaze material.

Figure 5:
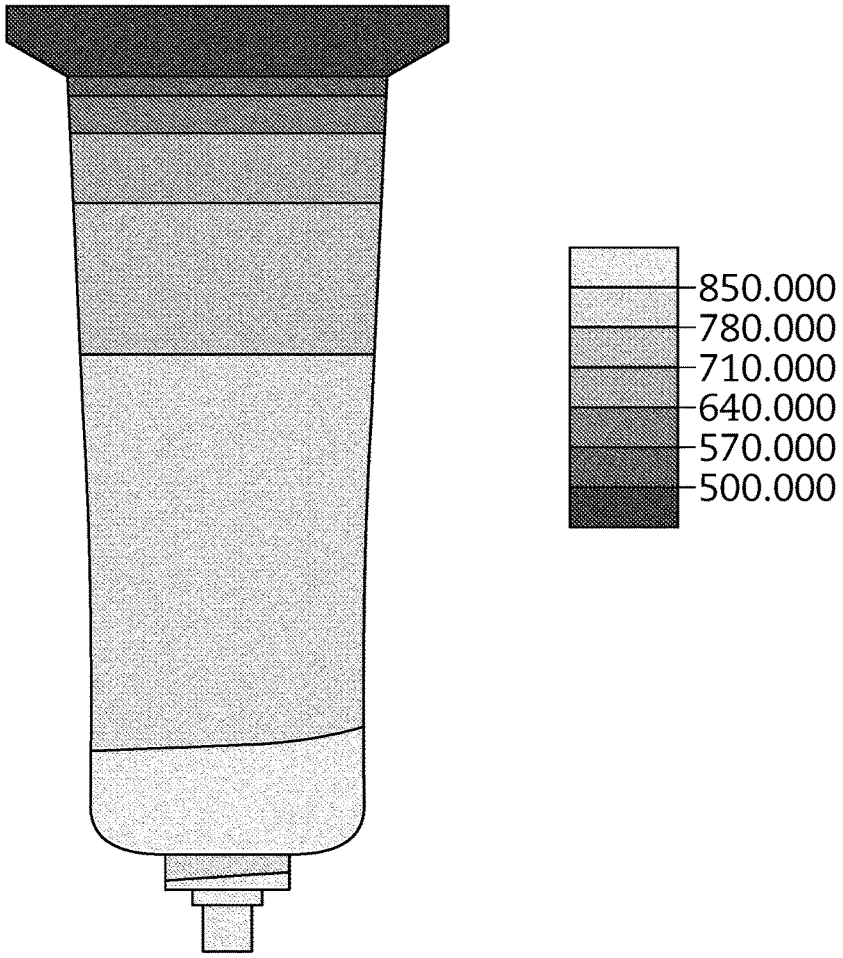
FIG. 5 (PRIOR ART)
FIG. 5 is a picture depicting a temperature gradient along a portion of the insulator of a typical spark plug.

During a combustion application, a temperature distribution along the third segment 54 (sometimes referred to as the core nose or nose cone) of the insulator 14 is always higher at the insulator tip 18 and gradually lowers toward the gasket seat 56. An exemplary temperature gradient for a typical spark plug is depicted in FIG. 5. As can be seen, a temperature at the insulator tip 18 adjacent the center electrode is about 850 degrees Celsius and slowly decreases away from the insulator tip 18. The insulator 14 adjacent the gasket seat 56 has a temperature of less than 600 degrees Celsius. Due to this temperature gradient, the first coating 132 may be comprised of a first glaze material having a first softening point and the second coating 134 may be comprised of a second glaze material having a second softening point, wherein the second softening point is lower than the first softening point. A higher softening point glaze at the insulator tip 18 provides an effective method for absorbing, for example, MMT deposits at the higher temperatures at the insulator tip 18 while avoiding devitrification and flake off of the higher softening point glaze material. The lower softening point glaze applied on the surface of the insulator 14 away from the insulator tip 18 provides an effective method for absorbing, for example, MMT deposits at the lower temperatures away from the insulator tip 18 while avoiding devitrification of the lower softening point glaze material. In exemplary embodiments, the two layers 132, 134 may be formed of the same or different materials.

The spark plug 130 may be manufactured in a typical fashion and, thereafter, the coatings 132, 134 may be applied. In an exemplary embodiment, both coatings 132, 134 may be applied and the coatings 132, 134 may thereafter be simultaneously fired. In an exemplary embodiment, for example, where the first and second coatings 132, 134 overlap, one of the layers 132, 134 may be applied and fired and the other layer 132, 134 may thereafter be applied and fired.

While two coatings 132, 134 are depicted in FIG. 4, any suitable number of coatings may be utilized. If more than two coatings are utilized, the softening point of each layer moving away from the insulator tip 18 may have a progressively lower softening point. A spark plug 130 with more than two coatings may be manufactured by applying each of the coatings and, thereafter, firing all of the coatings at the same time. Alternatively, any number of coatings may be applied and fired at the same time and any number of different application and firing steps may be utilized.

Figure 6:
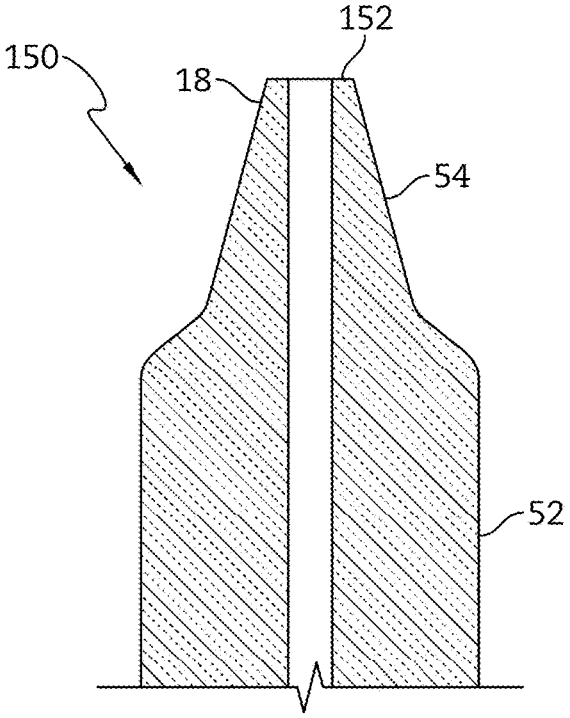
FIG. 6 is a cross-sectional view of an insulator having a segment that is tapered to create a narrowed tip.

In a further illustrative embodiment, any of the coatings herein may be utilized in combination with an insulator 150, as seen in FIG. 6. The insulator 150 may include first, second, and third segments 50, 52, 54 similar to the insulator 14 of FIG. 1 (only the second and third segments are shown in FIG. 6). In illustrative embodiments, the third segment 54 of the insulator 150 may be tapered from the second segment 52 to a reduced thickness tip 152, which assists, in combination with any of the coatings herein, in minimizing MMT deposits, for example. More particularly, a reduced thickness tip 152 reduces a temperature of the tip 152 in engine application and also protects the coating(s) applied to the insulator 150 from devitrification.

Figure 7:
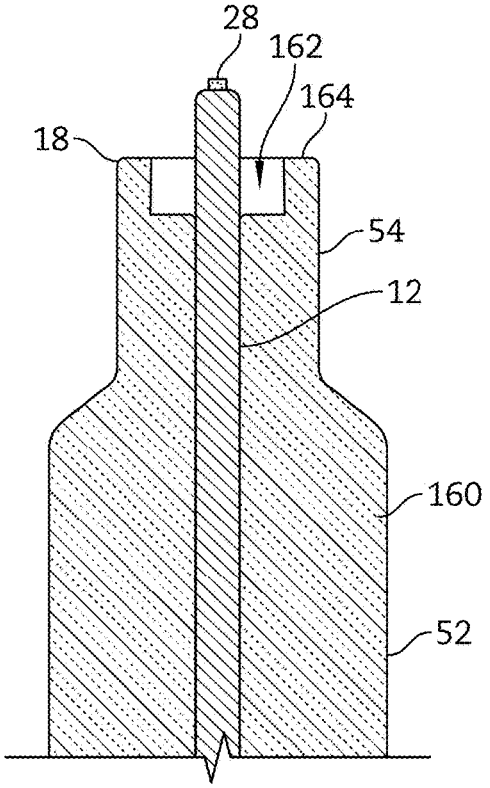
FIG. 7 is a cross-sectional view of an insulator having a cutout that forms a gap between a portion of the insulator and a center electrode.

In another illustrative embodiment, any of the coatings herein may be utilized in combination with an insulator 160, as seen in FIG. 7. The insulator 160 may include first, second, and third segments 50, 52, 54 similar to the insulator 14 of FIG. 1 (only the second and third segments are shown in FIG. 6). In illustrative embodiments, a gap 162 may be formed between at least a portion of the third segment 54 of the insulator 160 and a portion of the center electrode 12. The gap 162 may aid in reducing a temperature of an insulator tip 164, which reduces a temperature of the insulator tip 164 and reduces the temperature gradient along the insulator tip 164, which prolongs a life of the coating. The gap 162 also increases an insulative distance, which reduces the possibility of side firing or misfiring. In illustrative embodiments, any of the coatings disclosed herein may be utilized in combination with a reduced thickness tip 152 (FIG. 6) and/or a gap 162 between the insulator 14 and the center electrode 12 (FIG. 7).

In a further illustrative embodiment, an engine control system for a particular vehicle may be designed to minimize MMT deposits or similar deposits that can increase the likelihood of fouling. More particularly, to effectively absorb MMT deposits, for example, glaze materials in a coating need to reach their active temperatures (which are close to their softening point/temperature), however, a combustion chamber temperature that is too high may lead to devitrification of the glaze materials, which causes the glaze materials to lose their effectiveness. The engine may be designed to add a "regen" cycle that occurs on a periodic basis. In such an embodiment, the insulator 14 of the spark plug 10 may be coated with at least a high softening temperature glaze material. A "regen" cycle may consist of, after starting the engine, allowing MMT deposits to accumulate on the one or more glaze materials and, thereafter, increasing the temperature of the engine to a temperature that is higher than a softening point of the glaze material(s) or between about 400 and 1000 degrees Celsius. At this regen temperature, the glaze material(s) reacts, absorbs the MMT deposits, and renders a surface of the insulator non-conductive. Thereafter, during a normal engine run, the temperature in the engine is low enough to not cause significant devitrification of the glaze material(s) forming the coating. Using this method, a life of the glaze material(s) used in the coating would be prolonged.

A regen cycle may be a scheduled event that occurs on a periodic basis (e.g., weekly, monthly, or at any other suitable interval). Alternatively, a regen cycle may occur based on an event sensed by the engine control system, for example, based on an outside temperature, a temperature of the engine, a detecting misfiring of the spark plug, sensed or received torque information, or any other sensed or received abnormality or condition.

Any one or more of the coatings and/or layers of the present disclosure may incorporate a refractory powder in the glaze material thereof to improve a temperature sensitivity of the coating. Exemplary refractory powders include, but are not limited to, high temperature ceramic powders, alumina, zirconium oxide ($ZrO_2$), mullite, yittrium oxide ($Y_2O_3$), magnesium oxide (MgO), lanthium oxide ($La_2O_3$), boron nitride (BN), aluminum nitride (AlN), and the like, and combinations thereof. Such refractory materials may improve the heat resistance of the coating, thereby providing a more robust glaze material at higher temperatures. In illustrative embodiments, the glaze material may be mixed with one or more refractory powders and may, thereafter, be applied to the insulator and fired.

The following examples and representative procedures illustrate features in accordance with the present teachings, and are provided solely by way of illustration. They are not intended to limit the scope of the appended claims or their equivalents.

EXAMPLES

Exemplary Coating Formulations

Two representative coating formulations for use in accordance with the present teachings are prepared as shown in Table 1 below.

TABLE 1

Formulation of Coating Nos. 2 and 3

| Compound | Coating No. 2 Amount of Compound (weight %) | Coating No. 3 Amount of Compound (weight %) |
|---|---|---|
| $Na_2O$ | 0.59 | 0.34 |
| MgO | 5.27 | 5.69 |
| $Al_2O_3$ | 21.32 | 23.61 |
| $SiO_2$ | 58.64 | 55.78 |
| CaO | 12.49 | 14.58 |
| BaO | 1.69 | — |

The composition of coating nos. 2 and 3 is similar although the components are present in different ratios in each of the formulations. Coating nos. 2 and 3 may be used to target different melting temperatures. For example, coating no. 3 has a doubled weight % of high-temperature glass to that of coating no. 2. As a result, coating no. 3 is configured to survive higher engine temperature than coating no. 2. However, coating no. 3 requires a higher temperature to actively absorb MMT.

Coating nos. 2 and 3 may be applied on the tip (e.g., nose cone) of a spark plug insulator in thicknesses ranging, for example, from about 20 μm to about 30 μm.

Escape Chassis Dyno Test

Figure 8:
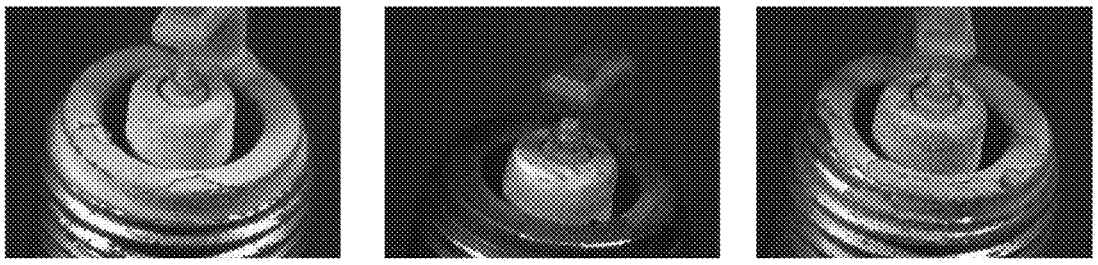
FIG. 8 shows photographs 100 hours after MMT test on a 2012 Ford 2.5-L engine of (a) a control spark plug having a non-coated insulator, (b) a spark plug having an insulator coated with coating no. 2, and (c) a spark plug having an insulator coated with coating no. 3.
Figure 9:
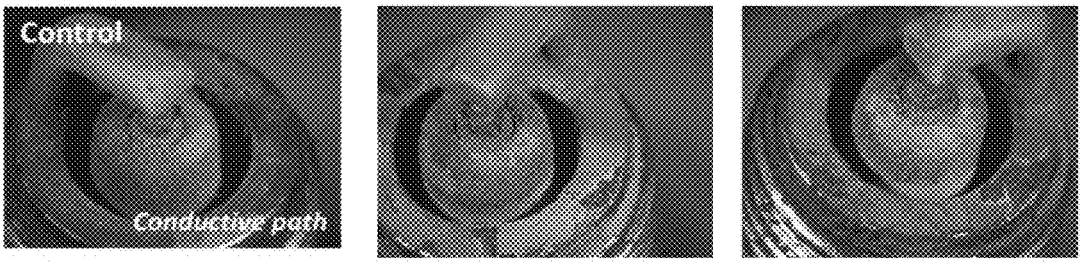
FIG. 9 shows photographs 300 hours after MMT test on a 2012 Ford 2.5-L engine of (a) a control spark plug having a non-coated insulator, (b) a spark plug having an insulator coated with coating no. 2, and (c) a spark plug having an insulator coated with coating no. 3.

FIGS. 8 and 9 show, respectively, photographs after a 100-hour MMT test and a 300-hour MMT test on a 2012 Ford 2.5-L engine. FIGS. 8*a* and 9*a* shows photographs of a control spark plug having a non-coated insulator, FIGS. 8*b* and 9*b* show photographs of a spark plug having an insulator coated with coating no. 2, and FIGS. 8*c* and 9*c* show photographs of a spark plug having an insulator coated with coating no. 3.

Significant "side firings" are observed on the non-coated part after the 100-hour test but are not observed on the coated parts. Moreover, as shown in FIG. 9*a*, a permanent conductive path is observed on the control part after the 300-hour test.

Figure 10:
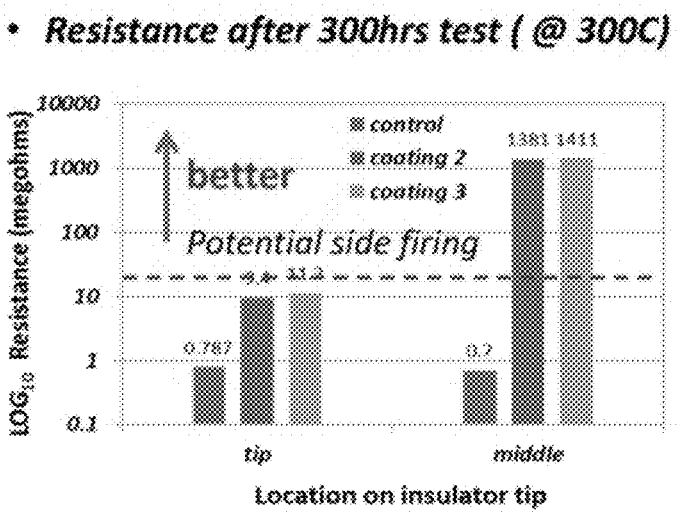
FIG. 10 shows a plot of resistance vs. location on insulator tip after a 300-hour MMT test.

FIG. 10 shows a plot of resistance vs. location on an insulator tip after the 300-hour MMT test. The left most bar graphs correspond to a control spark plug having a non-coated insulator, the middle bar graphs correspond to a spark plug having an insulator coated with coating no. 2, and the rightmost bar graphs correspond to a spark plug having an insulator coated with coating no. 3.

Scanning Electron Microscopy (SEM) Investigation of MMT Deposit

Figure 11:
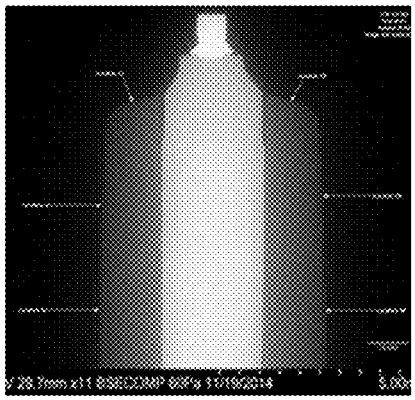
FIG. 11 shows a cross-sectional scanning electron microscopy (SEM) image of a middle region of a spark plug investigated by elemental analysis.

FIG. 11 shows a cross-sectional scanning electron microscopy (SEM) image of a middle region of a spark plug that is to be investigated by elemental analysis.

Figure 12:
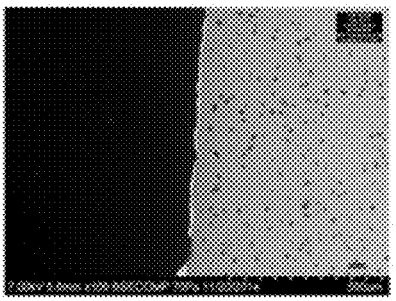
FIG. 12 shows, respectively, (a) a 100×SEM image of MMT deposited on the middle segment of a control spark plug having a non-coated insulator and (b) a 300×SEM image of MMT deposited on the middle segment of the control spark plug having the non-coated insulator.
Figure 12:
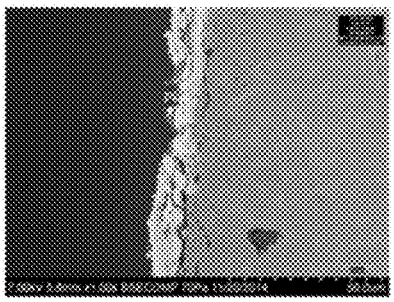
Figure 13:
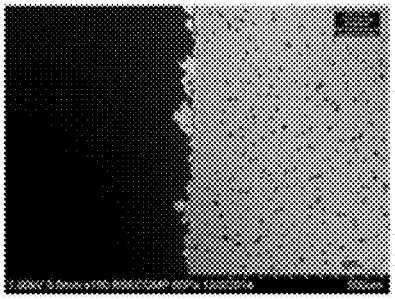
FIG. 13 shows, respectively, (a) a 100×SEM image of MMT deposited on the middle segment of a spark plug having an insulator coated with coating 1 and (b) a 300× SEM image of MMT deposited on the middle segment of the spark plug having the insulator coated with coating 3.
Figure 13:
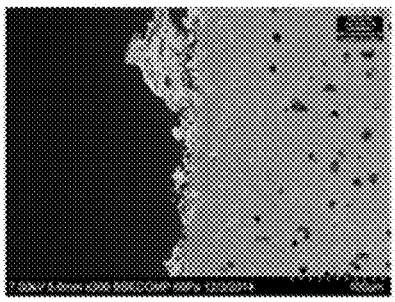
Figure 14:
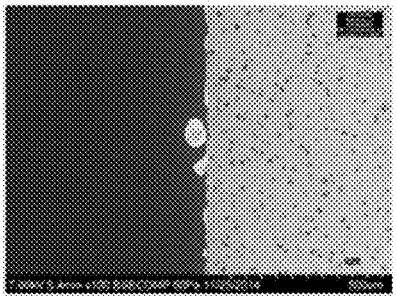
FIG. 14 shows, respectively, (a) a 100×SEM image of MMT deposited on the middle segment of a spark plug having an insulator coated with coating 3 and (b) a 300× SEM image of MMT deposited on the middle segment of the spark plug having the insulator coated with coating 3.
Figure 14:
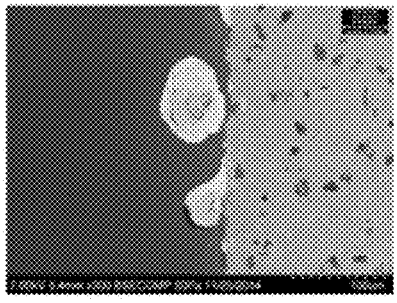

FIGS. 12*a* and 12*b* show, respectively, a 100× and 300× SEM image of MMT deposited on the middle segment of a control spark plug having a non-coated insulator. FIGS. 13*a* and 13*b* show, respectively, a 100× and 300×SEM image of MMT deposited on the middle segment of a spark plug having an insulator coated with coating no. 1. FIGS. 14*a* and 14*b* show, respectively, a 100× and 300×SEM image of MMT deposited on the middle segment of a spark plug having an insulator coated with coating no. 3.

As shown by the SEM photographs in FIGS. 12*a* and 12*b*, the MMT deposited on the control spark plug is dense and continuous. By contrast, as shown by the SEM photographs in FIGS. 13*a*, 13*b*, 14*a*, and 14*b*, the MMT deposited on the coated parts is loose and sporadic.

Energy-Dispersive x-Ray (EDX) Elemental Analysis of MMT Deposit

Figure 15:
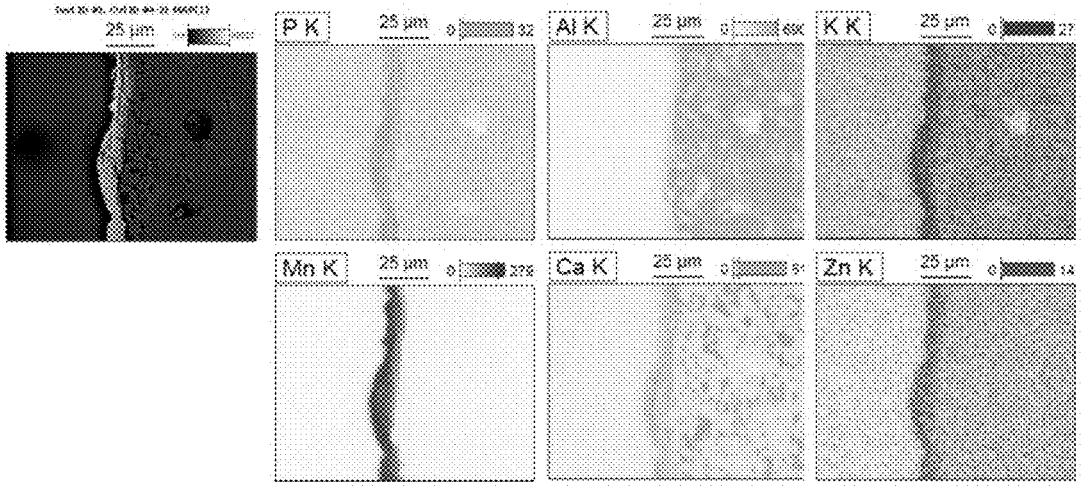
FIG. 15 shows plots of the distribution and relative proportion of elements contained in MMT deposited on the middle segment of a control spark plug having a non-coated insulator as determined by energy-dispersive x-ray (EDX) elemental analysis.

FIG. 15 shows plots of the distribution and relative proportion of elements contained in MMT deposits on the middle segment of a control spark plug having a non-coated insulator as determined by energy-dispersive x-ray (EDX) elemental analysis.

The EDX elemental analysis confirms that the deposit on the non-coated insulator of the control spark plug is primarily Mn oxides. In addition, the deposit contains P, K, Ca, and Zn, which are additives for engine oil/lubricants. These trace elements promote densification of the Mn deposit and further reduce the resistivity of the insulator.

Figure 16:
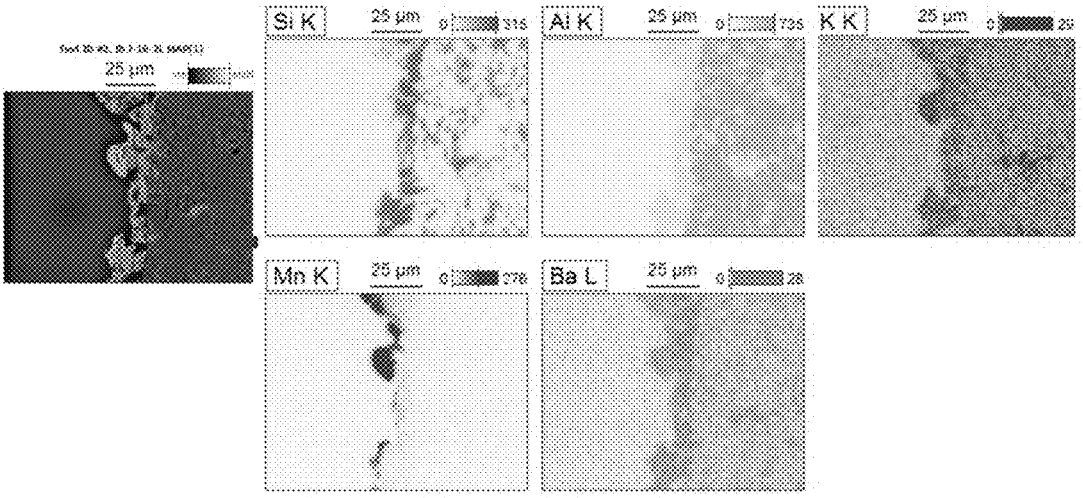
FIG. 16 shows plots of the distribution and relative proportion of elements contained in MMT deposited on the middle segment of a spark plug having an insulator coated with coating 1 as determined by EDX elemental analysis.

FIG. 16 shows plots of the distribution and relative proportion of elements contained in MMT deposited on the middle segment of a spark plug having an insulator coated with coating no. 1 as determined by EDX elemental analysis.

The Si/Ba distributions indicate the location of the coatings. The overlapping between Mn and Ba suggests that Mn is dissolved in the glaze coating As noted above, features of the spark plugs, the methods of applying the anti-fouling coatings (e.g. an anti-MMT fouling coatings), and the engine control system disclosed herein may be utilized in conjunction with any suitable spark plug. In this manner, the present disclosure and drawings herein shall not be limiting.

While the present disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

We claim:

1. A spark plug for an internal combustion engine, the spark plug comprising:

an elongated center electrode having a center electrode tip at a first end and a terminal proximate a second end opposite the first end;

an insulator surrounding at least a portion of the center electrode; and an outer shell surrounding at least a portion of the insulator;

wherein the insulator comprises:

a first segment surrounding at least a portion of the terminal, a second segment extending from the first segment, a third segment extending from the second segment, wherein a gap is disposed between the third segment of the insulator and the outer shell such that at least a portion of the third segment of the insulator is exposed to a combustion chamber when the spark plug is disposed within an internal combustion engine, and a coating applied to at least a portion of the third segment, wherein the coating is formed of a first layer disposed on at least a portion of a surface of the third segment and a second layer disposed on at least a portion of the first layer, wherein the first layer is formed of a first glaze material and the second layer is formed of a second glaze material, and the first glaze material and the second glaze material are different materials.

2. The spark plug of claim 1, wherein the first glaze material has a first softening point and the second glaze material has a second softening point and the second softening point is less than the first softening point.

3. The spark plug of claim 1, wherein a first thickness of the first layer and a second thickness of the second layer are different.

4. The spark plug of claim 1, wherein the coating extends between an end of the insulator disposed adjacent the center electrode and a point where the outer shell retains the insulator in position.

5. The spark plug of claim 1, wherein the coating extends along a surface of the insulator and ends at a point that is spaced from the center electrode or a point where the outer shell retains the insulator in position.

6. The spark plug of claim 1, further including a third layer disposed on at least a portion of the second layer.

7. The spark plug of claim 1, wherein at least one of the first and second glaze materials includes a refractory powder.

8. The spark plug of claim 7, wherein the refractory powder is selected from the group consisting of a high temperature ceramic powder, alumina, zirconium oxide ($ZrO_2$), mullite, yittrium oxide ($Y_2O_3$), magnesium oxide (MgO), lanthium oxide ($La_2O_3$), boron nitride (BN), aluminum nitride (AlN), and combinations thereof.

9. The spark plug of claim 1, wherein a gap is formed between the insulator and the center electrode.

10. The spark plug of claim 1, wherein the third segment of the insulator is tapered from a first end adjacent the second segment toward a second end opposite the second segment such that a thickness of the insulator at the second end is less than a thickness of the insulator at the first end.

11. A spark plug for an internal combustion engine, the spark plug comprising:

an elongated center electrode having a center electrode tip at a first end and a terminal proximate a second end opposite the first end;

an insulator surrounding at least a portion of the center electrode; and an outer shell surrounding at least a portion of the insulator;

wherein the insulator comprises:

a first segment surrounding the terminal, a second segment extending from the first segment, a third segment extending from the second segment, wherein a gap is disposed between the third segment of the insulator and the outer shell such that at least a portion of the third segment of the insulator is exposed to a combustion chamber when the spark plug is disposed within an internal combustion engine, and a first coating applied to a first portion of the third segment, and a second coating applied to a second portion of the third segment, wherein at least a portion of the second coating is disposed between the first coating and the second segment.

12. The spark plug of claim 11, wherein the first and second coatings abut one another and do not overlap.

13. The spark plug of claim 11, wherein the first coating is comprised of a first glaze material having a first softening point and the second coating is comprised of a second glaze material having a second softening point that is lower than the first softening point.

14. The spark plug of claim 13, wherein the first and second glaze materials are different materials.

15. The spark plug of claim 11, further including a third coating applied to a third portion of the third segment between the second coating and the second segment.

16. The spark plug of claim 11, wherein the first coating is formed of a first glaze material and the second coating is formed of a second glaze material, wherein at least one of the first and second glaze materials includes a refractory powder.

17. The spark plug of claim 16, wherein the refractory powder is selected from the group consisting of a high temperature ceramic powder, alumina, zirconium oxide ($ZrO_2$), mullite, yittrium oxide ($Y_2O_3$), magnesium oxide (MgO), lanthium oxide ($La_2O_3$), boron nitride (BN), aluminum nitride (AlN), and combinations thereof.

18. An insulator for a spark plug, the insulator comprising:

a first segment surrounding at least a portion of a terminal, a second segment extending from the first segment, a third segment extending from the second segment, and a coating applied to at least a portion of the third segment, wherein the coating is formed of a first layer disposed on at least a portion of a surface of the third segment and a second layer disposed on at least a portion of the first layer, wherein the first layer is formed of a first glaze material and the second layer is formed of a second glaze material, and the first glaze material and the second glaze material are different materials.

19. The spark plug of claim 18, wherein the first glaze material has a first softening point and the second glaze material has a second softening point and the second softening point is less than the first softening point.

20. The spark plug of claim 18, wherein a first thickness of the first layer and a second thickness of the second layer are different.

21. The spark plug of claim 18, further including a third layer disposed on at least a portion of the second layer.

22. The spark plug of claim 18, wherein at least one of the first and second glaze materials includes a refractory powder.

23. The spark plug of claim 22, wherein the refractory powder is selected from the group consisting of a high temperature ceramic powder, alumina, zirconium oxide ($ZrO_2$), mullite, yittrium oxide ($Y_2O_3$), magnesium oxide (MgO), lanthium oxide ($La_2O_3$), boron nitride (BN), aluminum nitride (AlN), and combinations thereof.

24. The spark plug of claim 18, wherein a gap is formed between the insulator and the center electrode.

25. The spark plug of claim 18, wherein the third segment of the insulator is tapered from a first end adjacent the second segment toward a second end opposite the second segment such that a thickness of the insulator at the second end is less than a thickness of the insulator at the first end.

26. An insulator for a spark plug, the insulator comprising:

a first segment surrounding a terminal, a second segment extending from the first segment, a third segment extending from the second segment, and a first coating applied to a first portion of the third segment, and a second coating applied to a second portion of the third segment, wherein at least a portion of the second coating is disposed between the first coating and the second segment.

27. The spark plug of claim 26, wherein the first and second coatings abut one another and do not overlap.

28. The spark plug of claim 26, wherein the first coating is comprised of a first glaze material having a first softening point and the second coating is comprised of a second glaze material having a second softening point that is lower than the first softening point.

29. The spark plug of claim 28, wherein the first and second glaze materials are different materials.

30. The spark plug of claim 26, further including a third coating applied to a third portion of the third segment between the second coating and the second segment.

31. The spark plug of claim 26, wherein the first coating is formed of a first glaze material and the second coating is formed of a second glaze material, wherein at least one of the first and second glaze materials includes a refractory powder.

32. The spark plug of claim 31, wherein the refractory powder is selected from the group consisting of a high temperature ceramic powder, alumina, zirconium oxide ($ZrO_2$), mullite, yittrium oxide ($Y_2O_3$), magnesium oxide (MgO), lanthium oxide ($La_2O_3$), boron nitride (BN), aluminum nitride (AlN), and combinations thereof.

* * * * *